US006286924B1

(12) United States Patent
Ahne et al.

(10) Patent No.: US 6,286,924 B1
(45) Date of Patent: Sep. 11, 2001

(54) APPARATUS AND METHOD FOR HEATING INK JET PRINTHEAD

(75) Inventors: Adam Jude Ahne, Lexington; Frank Edward Anderson, Sadieville, both of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/395,668

(22) Filed: Sep. 14, 1999

(51) Int. Cl.[7] ..... B41J 29/38; B41J 2/14; B41J 2/05

(52) U.S. Cl. ..... 347/10; 347/9; 347/48; 347/60; 347/61

(58) Field of Search ..... 347/10, 14, 56, 347/59, 60, 61, 62, 48

(56) References Cited

U.S. PATENT DOCUMENTS

| | | | | |
|---|---|---|---|---|
| 4,564,749 | | 1/1986 | Ishima | 219/497 |
| 5,083,137 | | 1/1992 | Badyal et al. | 347/14 |
| 5,175,565 | * | 12/1992 | Ishinaga et al. | 347/67 |
| 5,598,189 | | 1/1997 | Hess et al. | 347/9 |
| 5,635,968 | | 6/1997 | Bhaskar et al. | 347/59 |
| 5,734,392 | | 3/1998 | Cornell | 347/13 |
| 5,774,147 | | 6/1998 | Saito et al. | 347/59 |
| 5,815,180 | | 9/1998 | Barbour et al. | 347/59 |
| 5,867,183 | | 2/1999 | Cornell et al. | 347/17 |

* cited by examiner

*Primary Examiner*—John Barlow
*Assistant Examiner*—Alfred E. Dudding
(74) *Attorney, Agent, or Firm*—Needle & Rosenberg, P.C.

(57) ABSTRACT

An apparatus and method for heating an ink jet printhead by using pass transistors to generate heat and warm the substrate of the printhead. The ink jet printhead has a plurality of ink jet printhead nozzle. Each nozzle is controlled by a circuit. The circuit includes a drive transistor that is electrically coupled to a heating resistor, an enable transistor and a plurality of pass transistors. When the circuit receives a control signal having at least a first component and a second component, the first component being input to the gate of at least one pass transistor causing it to be active and generate a first output signal sufficient to activate the drive transistor, and the second component being input to the gate of the enable transistor causing the enable transistor to be active, a first current passes the heating resistor sufficient to cause a nozzle to fire, and a second current flows through both the at least one pass transistor and the enable transistor sufficient to generate heat and warm the substrate.

17 Claims, 5 Drawing Sheets

APPARATUS AND METHOD FOR HEATING INK JET PRINTHEAD

BACKGROUND OF THE INVENTION

1. Field of the Invention

The present invention relates to an apparatus and method for heating an ink jet printhead, and more particularly, to an apparatus and method for heating a substrate of an ink jet printhead using pass transistors.

2. Description of the Prior Art

An ink jet printer is a device that produces images on paper by firing precisely sized droplets of ink at precisely defined positions. Ink jet printers form droplets of ink in different ways. The most popular technique used in the art is the bubble jet. In a bubble jet printer, small resistors or heaters are energized to create heat that vaporizes ink to from a bubble. The expansion that creates the bubble causes a droplet of ink to form and eject from the printhead. A typical bubble jet printhead has 64 or 128 or more nozzles, and all of them can be energized to fire a droplet of ink simultaneously or individually.

Quality of the printed images formed by the droplets fired is a function of the printed spot size. Because the size of the printed spots, among other factors, is dependant on the mass of the individual droplets, better control of the drop mass is desired to improve image quality.

The mass of the ejected droplet is, in turn, a strong function of the ink temperature. Temperature relates to the thermal energy in the ink and the size of the vapor bubble that drives the ink from the firing chamber. In addition, temperature affects the viscosity, which in turn also affects the mass of a drop because of viscous losses in the firing chamber.

Attempts have been made at controlling the temperature of a thermal printhead for the purpose of controlling drop mass and thereby to control spot size and image quality. One technique includes using the thermal drop forming system to heat the printhead when it is not being used to form drops.

Currently there are two approaches to heat the printhead for the purpose of temperature control. The first approach is to use the existing heating resistors to also heat the substrate. In this approach, reduced energy pulses are applied to the drop-creation resistors or heaters. The reduced energy pulses do not contain enough energy to cause bubble nucleation and growth, but are sufficient to increase the temperature of the printhead. A potential drawback of using the active heating resistors to maintain the substrate temperature is the added workload to an already highly stressed, highly cycled component of the printer, which increases the probability of failure.

The second approach is to use separate substrate heaters. These substrate heaters are large area devices. They can be connected to a separate power source. Alternatively, they can be driven by a single power source that also provides power to the drop forming heaters during margin operations of the printer as disclosed in U.S. Pat. No. 5,734,392, which is incorporated herein by reference for the purpose of providing background information only. However, using a separate power source increases production cost while using a single power source does not provide a continuous substrate heating mechanism.

Therefore, the need still exists in the art for alternative printhead heating mechanism so as to better control the temperature of a thermal ink printhead.

SUMMARY OF THE INVENTION

The present invention relates to an apparatus and method for heating an ink jet printhead. Among other things, the present invention relates to the use of at least one pass transistor for substrate heating, in addition to the use of it for controlling of ink drop firing. The present invention makes a switch-free, more reliable and cost-efficient ink jet printhead temperature controlling system possible.

In this regard, one aspect of the invention relates to a circuit for controlling an ink jet printhead nozzle, where the printhead nozzle is located in a substrate. In one embodiment of the invention, the circuit includes a drive transistor having a drain, a gate and a source. The drain of the drive transistor is electrically coupled to an ink heating resistor and the source of the drive transistor is grounded. The circuit also includes an enable transistor having a drain, a gate and a source. The drain of the enable transistor is electrically coupled to the gate of the drive transistor and the source of the enable transistor is grounded. Moreover, the circuit has a pass transistor with a drain, a gate and a source. The source of the pass transistor is electrically coupled to both the gate of the drive transistor and the drain of the enable transistor.

In this embodiment, the on resistances of the drive transistor, the enable transistor and the first pass transistor are selected such that in a first operation mode, the first pass transistor and the enable transistor are active thereby to allow a first current to flow through both the first pass transistor and the enable transistor sufficient to generate heat and warm the substrate, and to generate a voltage between the drain and source of the enable transistor sufficient to activate the drive transistor allowing a second current to pass through the heating resistor and the drive transistor to cause the printhead nozzle to fire. The circuit may be operated at the first operation mode by applying a logic high to the gate of the first pass transistor, and a logic high to the gate of the enable transistor. The drive transistor is activated when the voltage between the drain and source of the enable transistor is sufficient to constitute a logic high to the gate of the drive transistor.

Additionally, the on resistances of the drive transistor, the enable transistor and the first pass transistor may be selected such that in a second operation mode, the first pass transistor and the enable transistor are active thereby to allow a third current to flow through both the first pass transistor and the enable transistor sufficient to generate heat and warm the substrate, and to generate a voltage insufficient to activate the drive transistor so that no current passes the heating resistor to cause the printhead nozzle to fire. The circuit may be operated at the second operation mode by applying a logic high to the gate of the first pass transistor, and a logic high to the gate of the enable transistor, but the voltage between the drain and source of the enable transistor is not sufficient to constitute a logic high to the gate of the drive transistor.

Furthermore, the circuit can include a plurality of second pass transistors. Each second pass transistor has a drain, a gate and a source. The drains of the plurality of the second pass transistor are electrically coupled in common to the drain of the enable transistor, and the sources of the plurality of the second pass transistors are grounded. If the circuit is in the first operational mode, at least one of the plurality of second pass transistors is active to allow a fourth current to flow through both the first pass transistor and the at least one of the plurality of second pass transistors sufficient to warm the substrate. On the other hand, if the circuit is in the second operational mode, at least one of the plurality of second pass transistors is active to allow a fifth current to flow through both the first pass transistor and the at least one of the plurality of second pass transistors sufficient to warm the substrate.

Another aspect of the invention relates to an ink jet printhead. The ink jet printhead includes a plurality of individually controllable ink jet nozzles, wherein each of the controllable ink jet nozzles is positioned in a substrate. The ink jet printhead also includes a plurality of ink jet nozzle control circuits, wherein each of the plurality of ink jet nozzle control circuits is positioned near a corresponding one of the plurality of individually controllable ink jet nozzles. Each ink jet nozzle control circuit includes a first switch element having a command input, a current input and a current output. The current input of the first switch element is electrically coupled to a first current source through a heating resistor and the current output of the first switch element is grounded. Moreover, the ink jet printhead includes a first pass element having a command input, a current input and a current output. The current input of the first pass element is coupled to a second current source and the current output of the first pass element is electrically coupled to the command input of the first switch element. Additionally, the ink jet printhead includes a plurality of second pass elements. Each of the plurality of second pass elements has a command input, a current input and a current output. The current inputs of the plurality of second pass elements are electrically coupled in common to the current output of the first pass element, and the current outputs of the plurality of second pass elements are commonly grounded. The ink jet printhead further includes at least one enable element, which has a command input, a current input and a current output. The current input of the enable element is electrically coupled to the current inputs of the plurality of second pass elements in common, and the current output of the enable element is electrically coupled to the current outputs of the plurality of second pass elements in common and is grounded.

In this embodiment, for each ink jet nozzle control circuit, the on resistances of the first switch element, the first pass element and the at least one enable element are selected such that in a first operation mode, the first pass element and the at least one enable element are active, thereby to allow a first current to flow through both the first pass element and the at least one enable element sufficient to generate heat and warm the substrate, and to generate a voltage between the drain and source of the at least one enable element sufficient to activate the first switch element allowing a second current to pass through the heating resistor and the first switch element to cause the corresponding ink jet nozzle to fire. The first switch element, the first pass element, the enable element and the plurality of second pass elements each may include a FET transistor.

In a further aspect, the invention relates to a method for controlling a thermal ink jet printhead, where the printhead includes at least one nozzle and a substrate. The method includes the step of coupling a pass transistor, an enable transistor and a driving transistor electrically. In an embodiment of the present invention, the drain of the driving transistor is electrically coupled to an ink heating resistor, the source of the pass transistor is electrically coupled to the drain of the enable transistor, the gate of the driving transistor is electrically coupled to the source of the pass transistor and the drain of the enable transistor, and the sources of the driving transistor and the enable transistor are grounded. The method also includes a step of driving the pass transistor and the enable transistor high enough to cause a current to flow through both the pass transistor and the enable transistor sufficient to generate heat and warm the substrate, and a voltage across the drain and the source of the enable transistor sufficient to activate the driving transistor so that at least one ink drop is fired from the ink heating resistor.

Practicing the present invention in one embodiment further includes the step of driving the pass transistor and the enable transistor high enough to cause a current to flow through both the pass transistor and the enable transistor sufficient to generate heat and warm the substrate, but the voltage across the drain and the source of the enable transistor is insufficient to activate the selected driving transistor so that no ink drop is fired from the ink heater resistor.

Additional advantages and features of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE INVENTION

The description of this invention is given by way of examples. The embodiments are now described with reference to the figures, in which like numbers indicate like parts throughout the figures. Although the examples are specific, the invention may be applied to different printhead configurations, in different dimensions, and with different layouts. As used in the specification and in the claims, "a" can mean one or more, depending upon the context in which it is used.

Printhead with Ink Jet Nozzles

Figure 1:
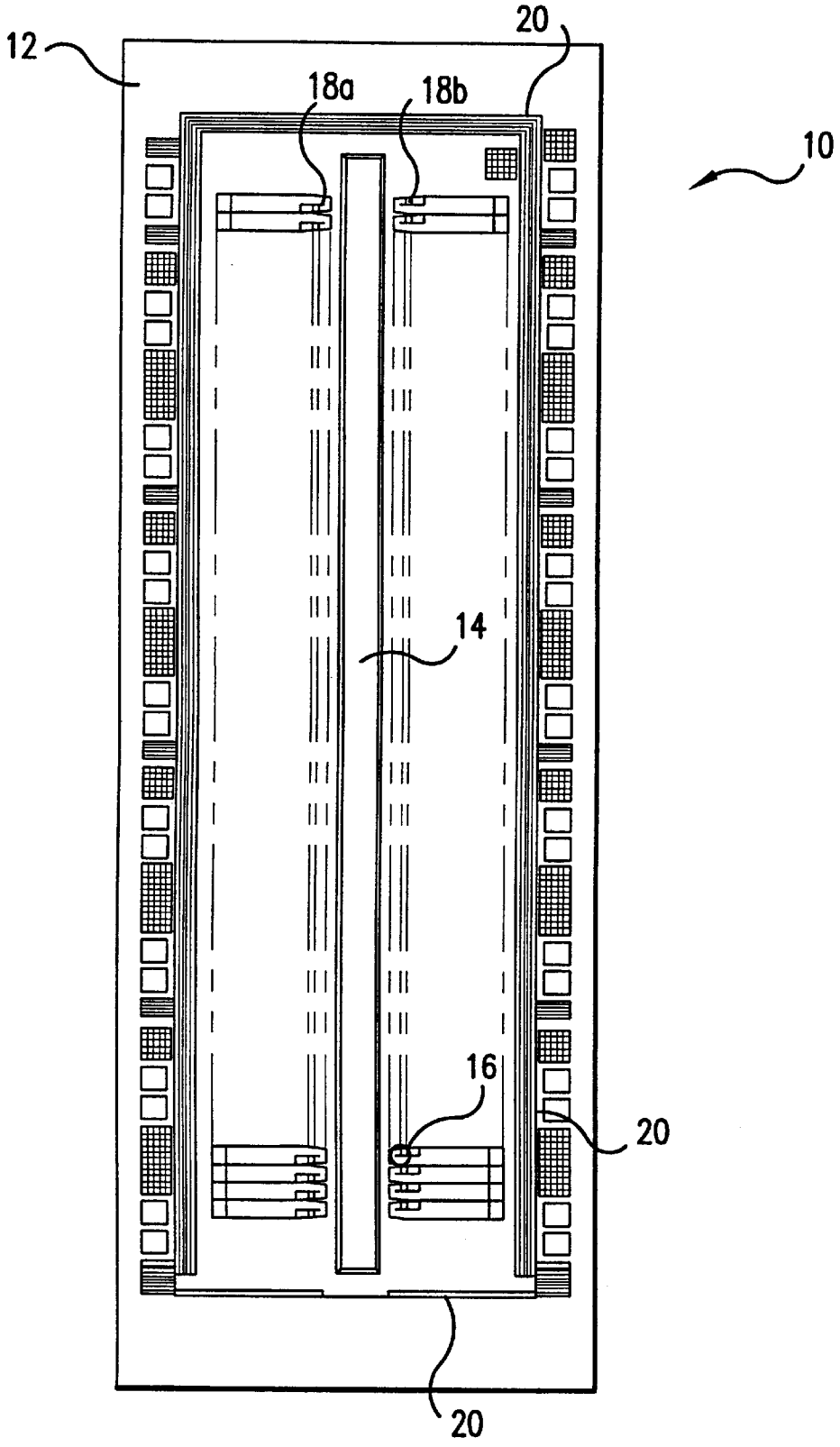
FIG. 1 is a schematic view of an exemplary printhead that has ink jet nozzles positioned in a substrate, which may be used in the present invention.

FIG. 1 schematically shows an exemplary printhead 10 of an ink jet printer that may be used with the present invention. The printhead 10 is essentially standard for this technology, having a substrate 12 and control leads and drive FET transistors populated on the substrate 12. These control leads and drive FET transistors are standard and therefore not shown in detail in FIG. 1. The substrate 12 is a silicon wafer or chip. All elements on substrate 12 are formed by ion implant or other standard techniques of semiconductor circuit fabrication. Also found on the substrate 12 is a long, central hole or channel 14 to transmit ink from a reservoir (not shown) to plurality of nozzles 16, which have been positioned in two columns 18*a* and 18*b*. Optionally, an encircling resistor 20 is embedded in substrate 12. The resistor 20 is located around the substrate periphery so as to be proximate to much of the substrate 12 as a whole. Resistor 20 may be employed as a temperature sensor by measuring current through the resistor 20 at controlled voltages. Resistor 20 may be made of resistivity heat-responsive material, such as aluminum.

Figure 2:
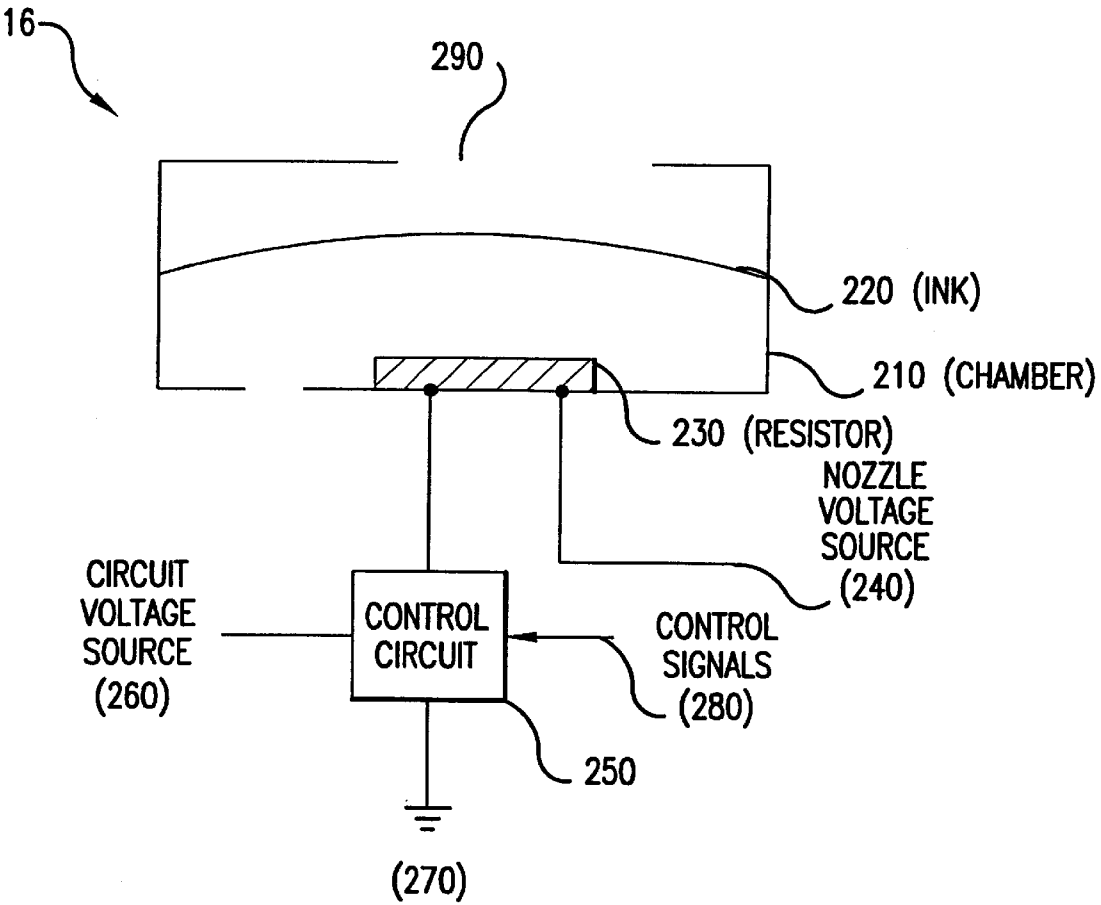
FIG. 2 is a schematic view of an ink jet nozzle of FIG. 1.

Referring now to FIG. 2, each nozzle 16 includes a nozzle chamber 210 for holding ink 220 and a heating resistor 230. The nozzle chamber 210 has an opening 290 through which an ink drop can be fired. The heating resistor 230 is electrically coupled to a nozzle voltage source 240 (not shown) and a control circuit 250. The control circuit 250 is properly coupled to ground 270, and is electrically coupled to a voltage source 260 (not shown). Voltage sources 240, 260 may be separate or a unified source. The control circuit 250 also receives a control signal 280. Physically, each nozzle 16 including control circuit 250 is embedded in substrate 12.

Nozzle Control Circuitry Schematic (I)

Figure 3:
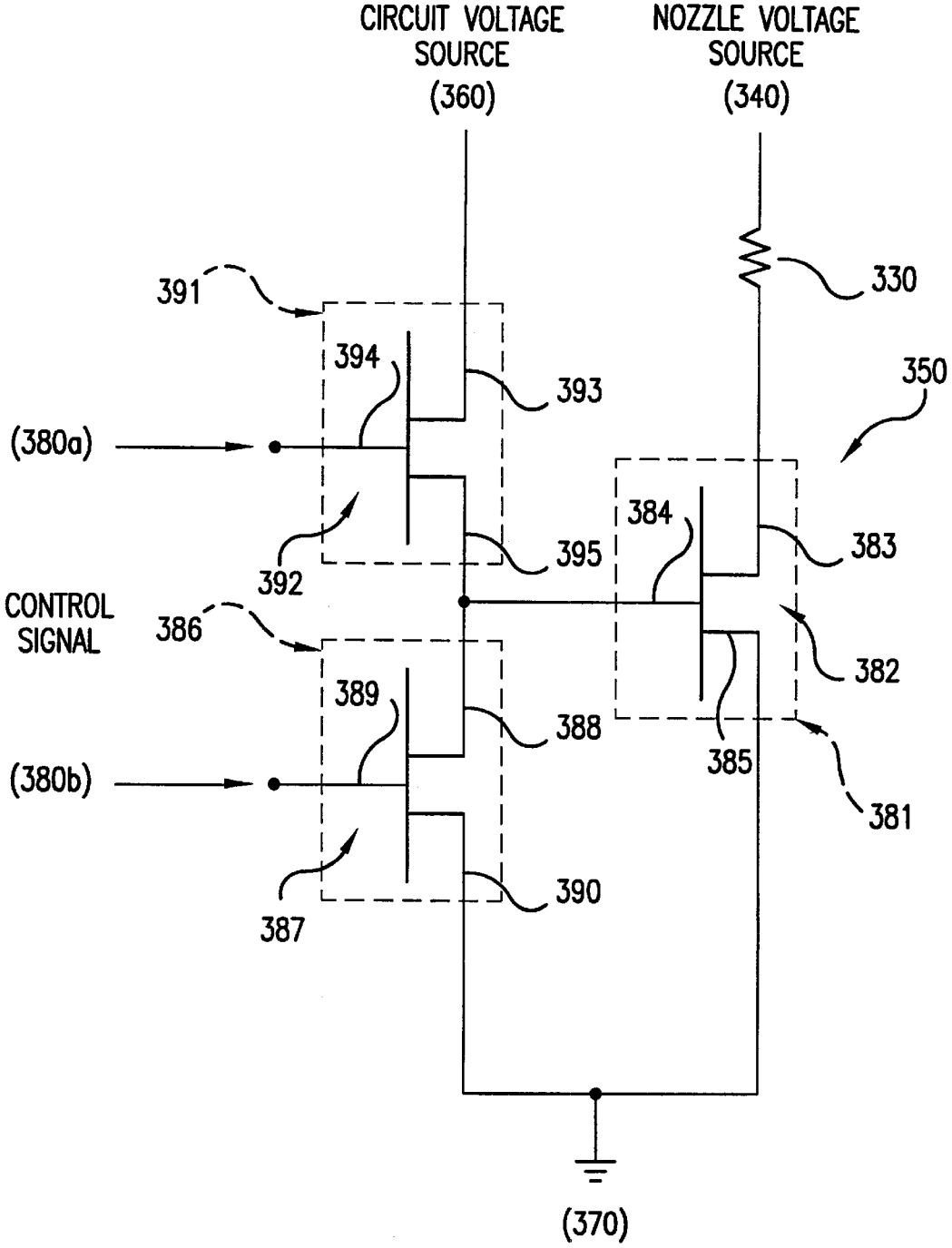
FIG. 3 is a schematic view of a control circuit for a given nozzle according to a first embodiment of the invention.

FIG. 3 is a schematic diagram of a nozzle control circuit 350 that may be associated with a given nozzle 16, according to one embodiment of the present invention. The nozzle circuit 350 includes a drive element 381, an enable element 386 and a pass element 391. The drive element 381 includes a drive transistor 382 with a drain 383, a gate 384 and a source 385. The enable element 386 includes an enable transistor 387 with a drain 388, a gate 389 and a source 390. And the pass element 391 includes a pass transistor 392 with a drain 393, a gate 394 and a source 395. The drive transistor 382, enable transistor 387 and pass transistor 392 each may be a power field effect transistor (FET) device. For the embodiment illustrated in FIG. 3, the drive transistor 382, enable transistor 387 and pass transistor 392 each is a FET device.

As shown in FIG. 3, a heating resistor 330 is electrically coupled to a nozzle voltage source 340 (not shown) at one contact and to the drain 383 of the drive transistor 382 at another contact. The drain 393 of the pass transistor 392 is electrically coupled to a circuit voltage source 360 (not shown). The drain 388 of the enable transistor 387 and the gate 384 of the drive transistor 382 are electrically coupled in common to the source 395 of the pass transistor 392. The sources 390, 385 of the enable transistor 387 and drive transistor 382 are electrically coupled in common to ground 370. The gate 394 of the pass transistor 392 receives control signal 380*a* and the gate 389 of the enable transistor 387 receives control signal 380*b*. The control signals 380*a* and 380*b* can be separate signals or components of a combined control signal.

Each of the transistors has an on resistance ranging from a few ohms to a few thousand ohms. However, in the embodiment shown in FIG. 3, the on resistance of the drive transistor 382 is at least ten (10) times smaller than either of the on resistance of the pass transistor 392 and the enable transistor 387. Moreover, in a preferred embodiment, the on resistance of the pass transistor 392 is chosen substantially same to the on resistance of the enable transistor 387 so that a proper drain to source voltage of the enable transistor 387 may be generated to the gate 384 of the drive transistor 382. In one example, the on resistance of the drive transistor 382 is about five (5) ohms while the one resistance of the pass transistor 392 or the enable transistor 387 is about two hundred (200) ohms. The selection of the on resistances of the drive transistor 382, enable transistor 387, and pass transistor 392 also minimizes the voltage drop across the drive transistor 382 and therefore maximizes the current passing the drive transistor 382. Moreover, because the size (and thus cost) of each transistor is inversely proportional to the on resistance, the selection of the on resistances in the preferred embodiment of the present invention can optimize the largest tolerable on resistance values of each transistor without incurring additional cost.

If a given nozzle 16 is selected to fire an ink droplet, the control circuit 350 receives a control signal correspondingly to enter a first operation mode. In this first operation mode, the control signal may include at least a first component and a second component. The first component of the control signal is input as control signal 380*a* to the gate 394 of the pass transistor 392 to drive the pass transistor 392 logic high thereby causing the pass transistor 392 to be active. In response, the pass transistor 392 generates an output at its source 395, which is received at the drain 388 of the enable transistor 387 and the gate 384 of the drive transistor 382 as inputs. The second component of the control signal is input as control signal 380*b* to the gate 389 of the enable transistor 387 to drive the enable transistor 387 logic high causing the enable transistor 387 to be active. Consequently, a current flows from circuit voltage source 360 through the pass transistor 392 and then the enable transistor 387 to ground 370. This current generates heat in the printhead and thus allows substrate warming. Because the on resistance of the pass transistor 392 is chosen substantially same to the on resistance of the enable transistor 387, moreover, the voltage across the drain 388 and the source 390 of the enable transistor 387 is sufficient to constitute a logic high to the gate 384 of the drive transistor 382. The drive transistor 382 is therefore activated so that the junction from drain 383 to source 385 at the drive transistor 382 is open. Thus, another current flows from the nozzle voltage source 340 through the heating resistor 330 to cause the nozzle 16 to fire.

In a second operation mode, the given nozzle 16 is not selected to fire an ink droplet. A first component of the control signal is input as control signal 380*a* to the gate 394 of the pass transistor 392 to drive the pass transistor 392 logic high thereby causing the pass transistor 392 to be active. A second component of the control signal is input as control signal 380*b* to the gate 389 of the enable transistor 387 to drive the enable transistor 387 logic high causing the enable transistor 387 to be active. Consequently, a current flows from circuit voltage source 360 through the pass transistor 392 and then the enable transistor 387 to ground 370. This current generates heat in the printhead and thus allows substrate warming. However, in this operation mode, the voltage across the drain 388 and the source 340 of the enable transistor 387 is insufficient to constitute a logic high to activate the drive transistor 382. Thus, the junction from drain 383 to source 385 at the drive transistor 382 is closed. Thus, no current flows from the nozzle voltage source 340 through the heating resistor 330 to cause the nozzle to fire. Alternatively, the voltage across the drain 388 and the source 390 may be kept sufficient to constitute a logic high to activate the drive transistor 382, but heating resistor 330 is decoupled from the nozzle voltage source 340, i.e., heating resistor 330 is not addressed, there would be no current to pass through heating resistor 330 to cause the nozzle to fire.

Therefore, control circuit 350 can be used to warm substrate 12 at all times, not just in the margins and without interrupting printing. This may provide a finer control of the substrate temperature and thus enhance the quality of printing.

In the preferred embodiment described above, the on resistance of the pass transistor 392 is chosen substantially same to the on resistance of the enable transistor 387. In another embodiment, however, the on resistance of the pass transistor 392 is different from the on resistance of the enable transistor 387. Indeed, the ratio of the on resistance of the pass transistor 392 to the on resistance of the enable transistor 387 can be adjusted as long as the drain to source voltage of the enable transistor 387 is sufficient to keep the drive transistor 382 active while the circuit 350 is providing substrate warming or vice versa.

The nozzle voltage source 340 and the circuit voltage source 360 can be a single or separate voltage sources. They may provide different voltage/current levels compatible with specifics of a printhead may require. They should have enough capacity to source currents to meet various needs of the heating resistor 330 and the control circuit 350.

In one embodiment, the nozzle voltage and the circuit voltage both are 11.75 Volts. The on resistance of the drive transistor 382 is about 5 ohms, and the on resistance of both the pass transistor 392 and the enable transistor 387 is about 200 ohms. In this embodiment, the power generated to warm the substrate 12 by the circuit 350 is about (11.75V)×(11.75V)/(200 ohms+200 ohms)=0.35 Walts. Other voltage levels and current levels may be used in alternative embodiments to generate different warming powers.

Nozzle Control Circuitry Schematic (II)

Figure 4:
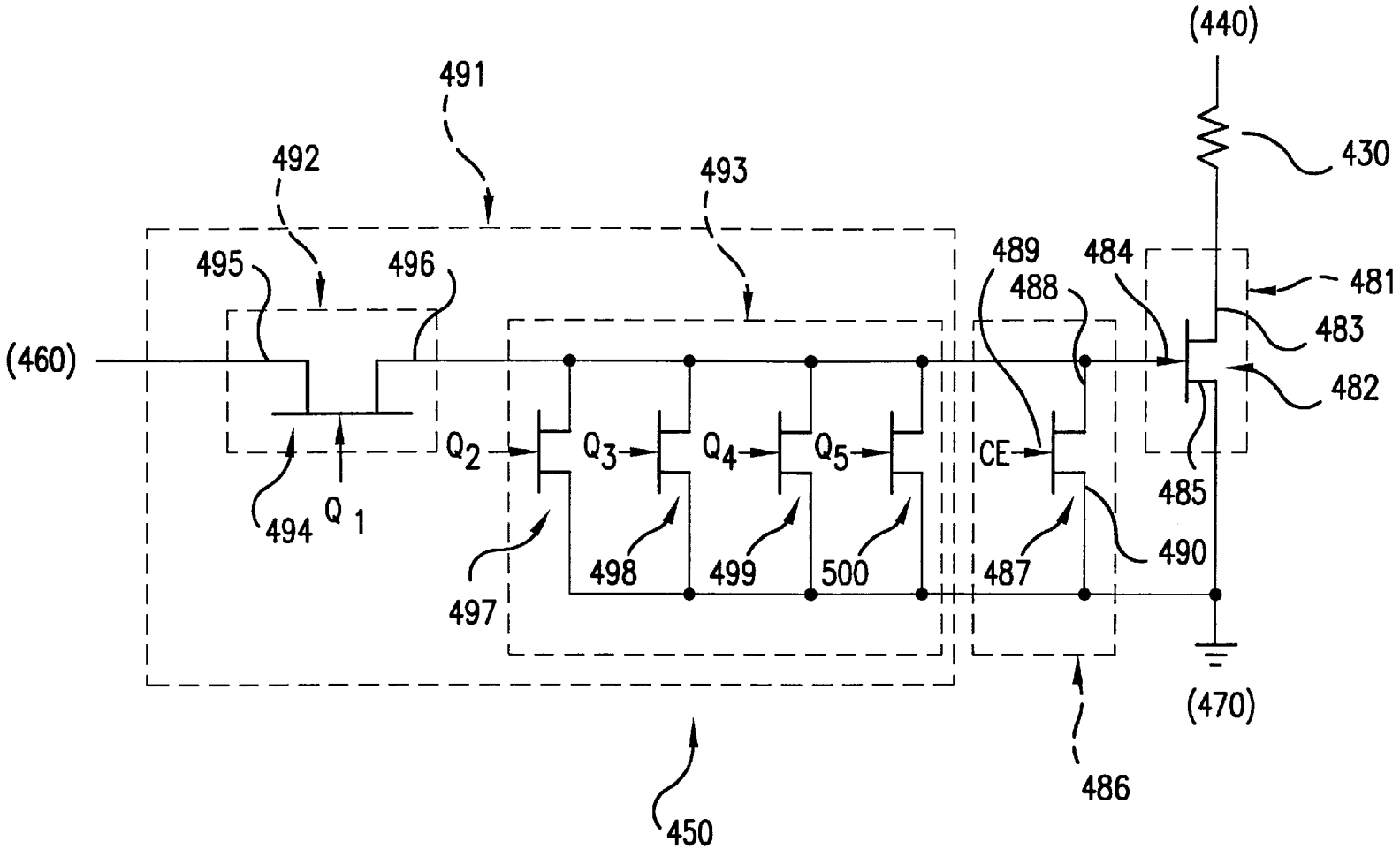
FIG. 4 is a schematic view of a control circuit for a given nozzle according to a second embodiment of the invention.

FIG. 4 is a schematic diagram of a nozzle circuit 450 that may be associated with a given nozzle 16, according to another embodiment of the present invention. The nozzle circuit 450 includes a drive element 481, an enable element 486 and a pass element 491. The drive element 481 comprises a drive transistor 482 with a drain 483, a gate 484 and a source 485. The enable element 486 comprises a pass transistor 487 with a drain 488, a gate 489 and a source 490. And the pass element 491 comprises a first pass element 492 and a second pass element 493. The first pass element 492 comprises a pass transistor 494 with a drain 495, a gate $Q_1$ and a source 496. The second pass element 493 comprises a plurality of pass transistors 497–500. Each of them has a drain, a gate and a source.

The drive transistor 482, enable transistor 487 and pass transistors 494, 497–500 each may include one power field effect transistor (FET) device. For the embodiment illustrated in FIG. 4, the drive transistor 482, enable transistor 487 and pass transistors 494, 497–500 each is a FET device. Each of them has an on resistance ranging from a few ohms to a few thousand ohms. However, in the embodiment shown in FIG. 4, the on resistance of the drive transistor 482 is at least ten (10) times smaller than either of the on resistance for any of the pass transistor 494, 497–500 and the enable transistor 487. Moreover, the on resistances of the pass transistors 494, 497–500 and the enable transistor 487 are substantially same to each other. In one to example, the on resistance of the drive transistor 482 is about five (5) ohms while the on resistance of each pass transistors 494, 497–500 or the enable transistor 487 is about two hundred (200) ohms. Moreover, although for the embodiment illustrated in FIG. 4 the second pass element 493 includes four pass transistors 497–500, the second element 493 can include more or less pass transistors.

As shown in FIG. 4, the heating resistor 430 is electrically coupled to a nozzle voltage source 440 (not shown) at one contact and to the drain 483 of the drive transistor 482 at another contact. The drain 495 of the pass transistor 494 of the first pass element 492 is electrically coupled to a circuit voltage source 460 (not shown). The drain 488 of the enable transistor 487 and the drains of the pass transistors 497–500 of the second pass element 493 are electrically coupled in common together with the gate 484 of the drive transistor 482 to the source 496 of the pass transistor 494. The sources 490 of the enable transistor 487, the source 485 of the drive transistor 482 and the sources of the pass transistors 497–500 are electrically coupled in common to ground 470. The gate of the pass transistor 494 receives control signal $Q_1$ and the gate of the enable transistor 487 receives control signal CE Each of the pass transistors 497–500 may receive one of control signals $Q_2$–$Q_5$ correspondingly at its gate. The control signals $Q_1$–$Q_5$, CE can be separate signals or components of a combined control signal.

If a given nozzle 16 is selected to fire an ink droplet, the control circuit 450 receives a control signal correspondingly to enter a first operation mode. In this first operation mode, the control signal may include at least a first component and a second component. The first component of the control signal is input as $Q_1$ to the gate of the pass transistor 494 of the first pass element 492 to drive the pass transistor 494 logic high thereby causing the pass transistor 494 to be active. In response, the pass transistor 494 generates an output at its source 496, which is received at the drain 488 of the enable transistor 487, drains of the pass transistors 497–500 of the second pass element 493 and the gate 484 of the drive transistor 489. The second component of the control signal is input as CE to the gate 489 of the enable transistor 487 to drive the enable transistor 487 logic high causing the enable transistor 487 to be active. Consequently, a current flows from circuit voltage source 460 through the pass transistor 494 and then the enable transistor 487 to ground 470. This current generates heat in the printhead and thus allows substrate warming. Additionally, this current generates a voltage across the drain 488 and the source 490 of the enable transistor 487. Because the on resistance of the enable transistor 487 is selected to be substantially same to the on resistance of each pass transistor and at least ten (10) times larger than that of the drive transistor 482, this voltage is driven logic high to the gate 484 of the drive transistor 482. The drive transistor 482 is therefore activated so that the junction from drain 483 to source 485 at the drive transistor 482 is open. Thus, another current flows from the nozzle voltage source 440 through the heating resistor 430 to cause the nozzle 16 to fire.

Optionally, in this first operation mode, the control signal may have other components as inputs $Q_2$–$Q_5$ to the gates of the pass transistors 497–500, respectively. In one embodiment, a control signal includes a third component $Q_2$ as input to the gate of the pass transistor 497, in addition to the first component as input $Q_1$ to the gate of the pass transistor 494 and the second component as input CE to the gate 489 of the enable transistor 487. The third component $Q_2$ drives the pass transistor 497 logic high causing the junction from drain to source of the pass transistor 497 to be open. A third current thus flows from the circuit voltage source 460 through the pass transistors 494 and 497 to ground 470. Because both pass transistors 494 and 497 have on resistance, heat will be generated when the third current passes them. In this embodiment, the pass transistor 494 sources both the current passing through the enable transistor 487 and the third current passing through the pass transistor 497. Alternatively, more pass transistors can be similarly driven high to provide more heat and fine temperature control. Moreover, because in this embodiment the on resistances of the pass transistors 497–500 and the enable transistor 487 are chosen substantially same to each other, the voltage across the drain 488 and the source 490 is effectively reduced to below the threshold to turn the drive transistor 482 on. Thus, in addition to the use of them as heat-generating devices, these pass transistors shown in the configuration of FIG. 4 can prevent an unselected drive transistor from turning on.

In a second operation mode, the given nozzle 16 is not selected to fire an ink droplet. The control circuit 450 relieves a control signal that includes at least a first component and a second component. The first component of the control signal is input as $Q_1$ to the gate of the pass transistor 494 of the first pass element 492 to drive the pass transistor 494 logic high thereby causing the pass transistor 494 to be active. The second component of the control signal is input as CE to the gate 489 of the enable transistor 487 to drive the enable transistor 487 logic high causing the enable transistor 487 to be active. Consequently, a current flows from circuit voltage source 460 through the pass transistor 494 and then the enable transistor 487 to ground 470. This current generates heat in the printhead and thus allows substrate warming. However, in the second operation mode, the voltage across the drain 488 and the source 490 of the enable transistor 487 is not driven logic high enough to activate the drive transistor 482. Thus, the junction from drain 483 to source 485 at the drive transistor 482 is closed. Consequently, no current flows from the nozzle voltage source 440 through the heating resistor 430 to cause the nozzle to fire. This operation mode can be achieved by driving one or more of the pass transistors $Q_2$–$Q_5$ high to allow more currents to flow and effectively lower the voltage across the drain 488 and the source 490 of the enable transistor 487 as known to the people skilled in the art.

In the preferred embodiment described above, the on resistance for each of the pass transistors 494, 497–500 is chosen substantially same to the on resistance of the enable transistor 487. In another embodiment, the on resistance for each of the pass transistors 494, 497–500 is same to each other but different from the on resistance of the enable transistor 487. In a further embodiment, the pass transistors 494, 497–500 and the enable transistor 487 have different on resistance values. Optionally, the ratio of the on resistance of between any two of the pass transistors 494, 497–500 and the enable transistor 487 can be adjusted to provide fine control over the circuit 450 by, for instance, providing voltage at various level to the gate of the drive transistor 482.

The nozzle voltage source 440 and the circuit voltage source 460 can be a single power source or separate power sources. They may provide different voltage/current levels compatible with specifics of a printhead may require.

Additionally, although circuit 450 is shown preferably constructed with all transistors as being FET devices, people skilled in the art will recognize that each, some or all FET devices could be replaced by any device capable of performing substantially same function, such as for example, by replacing the FET devices with bipolar transistors.

Printhead with Ink Jet Nozzles

Although the invention has been described in relation to a single nozzle control circuit, the application of the invention is not so limited. The circuitry of the present invention can be incorporated in a currently available printer having any number of control circuits greater than one.

The printer may include any number of printheads. Each printhead would have a plurality of inkjet nozzles. Each ink jet nozzle is controlled by a control circuit of the invention. As known to the people skilled in the art, these ink jet nozzles can form a matrix where each ink heater resistor associated with a corresponding ink jet nozzle can be individually addressable by an address (A(1), P(m), Q(n)). Integers 1, m, n indicate a location of a selected ink jet nozzle (A(1), P(m), Q(n)) in the matrix. Integer 1 runs from 1 to L, wherein L is a positive integer. Integer m runs from 1 to M, wherein M is a positive integer. And integer n runs from 1 to N, wherein N is a positive integer. (L, M, N) determine the dimension of the matrix of the ink jet nozzles. The product of L×M×N gives the total number of the ink jet nozzles. For example, if L=10, M=10, and N=5, the printhead would have 10×10×5=500 nozzles. People skilled in the art would identify this printhead as having 10 A-lines, 10 P-lines and 5 Q-lines. For the embodiment shown in FIG. 4, people skilled in art would, for example, consider that the drain of the pass transistor 494 is connected to an A-line, the heater resistor 430 is connected to a P-line and the gates of the pass transistors 494, 497–500 each is connected to a Q-line.

Figure 5:
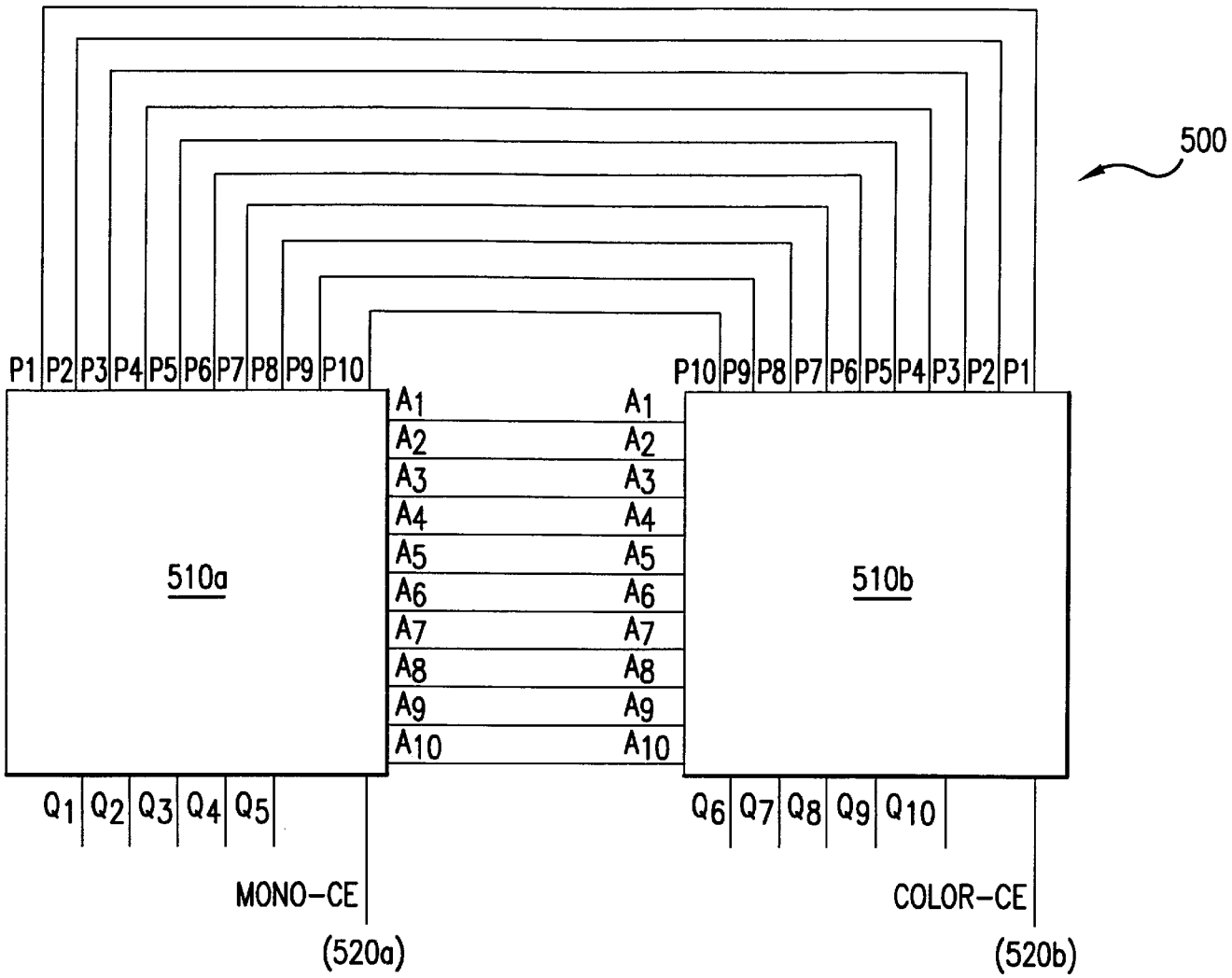
FIG. 5 is a diagram of a layout pattern with an array of ink jet nozzle control circuits of FIG. 4 according to an embodiment of the invention.

FIG. 5 shows a configuration of a printer 500 with two printheads 510*a* and 510*b*. Each printhead has 10 A-lines (A1–A10), 10 P-lines (P1–P10) and 5 Q-lines (Q1–Q5) for printhead 510*a* or (Q6–Q10) for printhead 510*b*. Therefore, each printhead has 500 ink jet nozzles inside. Each ink jet nozzle is individually controlled by a control circuit of the invention (not shown). Printhead 510*a* is used to produce a mono image, and printhead 510*b* is used to produce a color image, or vice versa. Gate 520*a* is electrically coupled to the gate of a first enable transistor (not shown) and gate 520*b* is electrically coupled to the gate of a second enable transistor (not shown). For the embodiment shown in FIG. 5, the printer 500 is selected by control signals received at the gates 520*a*, 520*b* to print with one printhead at a time. In this embodiment, the P-lines and A-lines are therefore common between the printhead 510*a* and 510*b*. However, the Q-lines are not common.

Thus, in operation, to select a printhead to print, for example, to select printhead 510*a* to print, gate 520*a* is received a signal to activate the first enable transistor (not shown). If a logic high is received at the gate of a pass transistor (not shown), whose source is electrically coupled to the drain of the first enable transistor, the pass transistor is activated and generates a first output signal to activate a drive transistor (not shown) to cause a first current to pass the heater resistor sufficient to fire an ink drop. Meanwhile, a second current passes the pass transistor and the enable transistor to ground thus generating heat to warm the substrate (not shown). If this given nozzle is not selected to fire ink, no current will pass the drive transistor and the heater resistor. Only a current passes the pass transistor and the enable transistor to generate heat to warm the substrate. The process is similar if printhead 510*b* is selected to print.

While the invention has been described in detail with specific reference to preferred embodiments thereof, it is understood that variations and modifications thereof may be made without departing from the spirit and scope of the invention.

For example, although specific voltage levels, current levels and logic states are described, different values and logic states are implemented for alternative embodiments. Therefore, the foregoing description should not be taken as limiting the scope of the inventions that are defined by the following claims.

What is claimed is:

1. A circuit for controlling an ink jet printhead nozzle, the printhead nozzle being located in a substrate, the circuit comprising:

(a) a drive transistor having a drain, a gate and a source, the drain of the drive transistor electrically coupled to an ink heating resistor and the source of the drive transistor grounded;

(b) an enable transistor having a drain, a gate and a source, the drain of the enable transistor electrically coupled to the gate of the drive transistor and the source of the enable transistor grounded; and (c) a first pass transistor with a drain, a gate and a source, the source of the pass transistor electrically coupled to both the gate of the drive transistor and the drain of the enable transistor, where on resistances of the drive transistor, the enable transistor and the first pass transistor are selected such that in a first operation mode, the first pass transistor and the enable transistor are active thereby to allow a first current to flow through both the first pass transistor and the enable transistor sufficient to generate heat and warm the substrate, and to generate a voltage between the drain and source of the enable transistor sufficient to activate the drive transistor allowing a second current to pass through the heating resistor and the drive transistor to cause the printhead nozzle to fire.

2. The circuit of claim 1, wherein each of an on resistance of the pass transistor and an on resistance of the enable transistor is at least ten (10) times larger than an on resistance of the drive transistor.

3. The circuit of claim 2, wherein the on resistance of the pass transistor is substantially same as the on resistance of the enable transistor so that a voltage between the drain and the source of the pass transistor is substantially equal to the voltage between the drain and source of the enable transistor.

4. The circuit of claim 2, wherein the on resistance of the pass transistor is different from the on resistance of the enable transistor so that a voltage between the drain and the source of the enable transistor is sufficient to keep the drive transistor active when the first current flows through both the pass transistor and the enable transistor to warm the substrate.

5. The circuit of claim 1, wherein the on resistances of the drive transistor, the enable transistor and the first pass transistor are selected such that in a second operation mode, the first pass transistor and the enable transistor are active thereby to allow a third current flowing through both the first pass transistor and the enable transistor sufficient to generate heat and warm the substrate, and to generate a voltage insufficient to activate the drive transistor so that no current passes the heating resistor to cause the printhead nozzle to fire.

6. The circuit of claim 1, further comprising a plurality of second pass transistors, each having a drain, a gate and a source, wherein the drains of the plurality of the second pass transistor are electrically coupled in common to the drain of the enable transistor, and the sources of the plurality of the second pass transistors are grounded.

7. The circuit of claim 6, wherein the on resistance of each of the plurality of the second pass transistors is at least (10) times larger than the on resistance of the drive transistor.

8. The circuit of claim 7, wherein the on resistance of each of the second pass transistors is substantially same as the on resistance of the enable transistor.

9. The circuit of claim 6, wherein in the first operational mode, at least one of the plurality of second pass transistors is active to allow at least a fourth current to flow through both the first pass transistor and the at least one of the plurality of second pass transistors sufficient to warm the substrate.

10. The circuit of claim 7, wherein in the second operational mode, at least one of the plurality of second pass transistors is active to allow at least a fifth current to flow through both the first pass transistor and the at least one of the plurality of second pass transistors sufficient to warm the substrate.

11. An ink jet printhead, comprising:

a. a plurality of individually controllable ink jet nozzles positioned in a substrate;

b. a plurality of ink jet nozzle control circuits, wherein each of the plurality of ink jet nozzle control circuits is positioned near a corresponding one of the plurality of individually controllable ink jet nozzles, each ink jet nozzle control circuit comprising:

i. a first switch element having a command input, a current input, a current output and an on resistance, wherein the current input is electrically coupled to a first current source through a heating resistor and the current output is grounded;

ii. a first pass element having a command input, a current input, a current output and an on resistance, wherein the current input of the first pass element is electrically coupled to a second current source and the current output of the first pass element is coupled to the command input of the switch element; and iii. a plurality of second pass elements, wherein each of them has a command input, a current input, a current output and an on resistance;

c. at least one enable element having a command input, a current input, a current output and an on resistance, the current input of the enable element is electrically coupled to the current inputs of the plurality of second pass elements in common, and the current output of the enable element is electrically coupled to the current outputs of the plurality of second pass elements in common and grounded, wherein for each ink jet nozzle control circuit, the on resistances of the first switch element, the first pass element and the at least one enable element are selected such that in a first operation mode, the first pass element and the at least one enable element are active, thereby to allow a first current to flow through both the first pass element and the at least one enable element sufficient to generate heat and warm the substrate, and to generate a voltage between the drain and source of the at least one enable element sufficient to activate the first switch element allowing a second current to pass through the heating resistor and the first switch element to cause the corresponding ink jet nozzle to fire.

12. The ink jet printhead of claim 11, wherein the first switch element comprises a drive transistor having a gate as the command input, a drain as the current input, and a source as the current output.

13. The ink jet printhead of claim 11, wherein the first pass element comprises a first pass transistor having a gate as the command input, a drain as the current input, and a source as the current output.

14. The ink jet printhead of claim 11, wherein each of the second pass elements comprises a second pass transistor having a gate as the command input, a drain as the current input, and a source as the current output.

15. The ink jet printhead in claim 12, wherein the first pass element comprises a first pass transistor and each of the second pass elements comprises a second pass transistor and further wherein the on resistance of the drive transistor is smaller than that of either the first pass transistor or any of the second pass transistors.

16. A method for controlling a thermal ink jet printhead, the printhead comprising a nozzle and a substrate, the method comprising the steps of:

(a) coupling a pass transistor, an enable transistor and a driving transistor electrically, wherein the drain of the driving transistor is electrically coupled to an ink heating resistor, the source of the pass transistor is electrically coupled to the drain of the enable transistor, the gate of the driving transistor is electrically coupled to the source of the pass transistor and the drain of the enable transistor, and the sources of the driving transistor and the enable transistor are grounded; and (b) driving the pass transistor and the enable transistor high enough to cause a current to flow through both the pass transistor and the enable transistor sufficient to generate heat and warm the substrate, and a voltage across the drain and the source of the enable transistor sufficient to activate the driving transistor so that at least one ink drop is fired from the ink heating resistor.

17. The method of claim 16, further comprising the step of driving the pass transistor and the enable transistor high to cause a current to flow through both the pass transistor and the enable transistor sufficient to generate heat and warm the substrate, but the voltage across the drain and the source of the enable transistor insufficient to activate the driving transistor so that no ink drop is fired from the ink heating resistor.

* * * * *